US009926899B2

(12) United States Patent
Kato et al.

(10) Patent No.: US 9,926,899 B2
(45) Date of Patent: Mar. 27, 2018

(54) FUEL-FILTER ABNORMALITY DETECTION DEVICE

(71) Applicants: KYOSAN DENKI CO., LTD., Koga, Ibaraki-pref. (JP); DENSO CORPORATION, Kariya, Aichi-pref. (JP)

(72) Inventors: Takafumi Kato, Oyama (JP); Toshiyuki Yonemoto, Nagoya (JP); Katsumi Mori, Chiryu (JP)

(73) Assignee: KYOSAN DENKI CO., LTD., Koga (JP)

( * ) Notice: Subject to any disclaimer, the term of this patent is extended or adjusted under 35 U.S.C. 154(b) by 0 days.

(21) Appl. No.: 14/739,125

(22) Filed: Jun. 15, 2015

(65) Prior Publication Data

US 2015/0360152 A1 Dec. 17, 2015

(30) Foreign Application Priority Data

Jun. 17, 2014 (JP) ..... 2014-124529

(51) Int. Cl.
*F02M 37/22* (2006.01)
*F02D 41/22* (2006.01)

(52) U.S. Cl.
CPC ..... *F02M 37/22* (2013.01); *F02D 2041/224* (2013.01)

(58) Field of Classification Search
CPC ..... B01D 29/606
See application file for complete search history.

(56) References Cited

U.S. PATENT DOCUMENTS

| | | | | | |
|---|---|---|---|---|---|
| 4,033,870 | A * | 7/1977 | Parquet | B01D 35/12 | 210/103 |
| 5,458,767 | A * | 10/1995 | Stone | B01D 17/0202 | 210/130 |
| 2002/0104796 | A1* | 8/2002 | Maxwell | B01D 17/12 | 210/416.1 |
| 2004/0055946 | A1* | 3/2004 | Schmidt | B01D 29/21 | 210/314 |

FOREIGN PATENT DOCUMENTS

| | | | |
|---|---|---|---|
| JP | 59-201965 | A | 11/1984 |
| JP | H06-1899 | U | 1/1994 |
| JP | 11-200975 | A | 7/1999 |
| JP | 2004-3426 | A | 1/2004 |
| JP | 2006-63856 | A | 3/2006 |
| JP | 2009-257103 | A | 11/2009 |
| JP | 2014-94323 | A | 5/2014 |

* cited by examiner

*Primary Examiner* — Peter Keyworth
(74) *Attorney, Agent, or Firm* — Posz Law Group, PLC

(57) ABSTRACT

A fuel-filter abnormality detection device is used for a subject filter provided in a fuel supply device of an engine to filtrate a fuel. The fuel-filter abnormality detection device includes a first filter attachable downstream of the subject filter in fuel flow. A filtration capacity of the first filter is smaller than a filtration capacity of the subject filter, and the first filter traps a foreign matter on a downstream side of the subject filter to cause a change in fuel pressure indicating an abnormality of the subject filter. The fuel-filter abnormality detection device may include a bypass passage through which the fuel bypasses the first filter, a bypass control valve configured to allow the fuel to flow through the bypass passage when the abnormality of the subject filter is detected, and a second filter filtrating the fuel flowing through the bypass passage.

30 Claims, 5 Drawing Sheets

FUEL-FILTER ABNORMALITY DETECTION DEVICE

CROSS REFERENCE TO RELATED APPLICATION

This application is based on and incorporates herein by reference Japanese Patent Application No. 2014-124529 filed on Jun. 17, 2014.

TECHNICAL FIELD

The present disclosure relates to a fuel-filter abnormality detection device that detects an abnormality in a fuel filter for a fuel supplied to an internal combustion engine.

BACKGROUND

Patent Document 1 (JP S59-201965 A) and Patent Document 2 (JP H11-200975 A) disclose a fuel supply device in which multiple fuel filters are disposed in series in a fuel passage. These configurations are advantageous to set a filtration capacity that is an amount of fuel that the fuel supply device is capable of filtering.

Patent Document 3 (JP 2009-257103 A) discloses a fuel-filter abnormality detection device that determines whether a fuel filter is clogged based on a fuel pressure.

As disclosed in Patent Documents 1 and 2, efforts have been made to set a predetermined filtration performance for protection of an internal combustion engine. On the other hand, in actual use, an engine may be operated without a fuel filter for various reason such as cost saving or unavailability of a replacement filter. Alternatively, a non-authentic product lower in filtration performance may be used. In these cases, a desired filtration performance cannot be obtained. In addition, in such usage environments, a low-quality fuel containing relatively-numerous foreign objects may be used. Thus, it may be difficult to protect the engine.

The fuel-filter abnormality detection device of Patent Document 3 detects filter clogging that is one of abnormalities of the fuel filter. However, as described above, when the fuel filter is not used, or when a low-quality fuel filter is used, a fuel pressure corresponding to the filter clogging is not detected. Thus, the abnormality of the fuel filter cannot be detected in usage without a fuel filter or usage with a low-quality fuel filter having a low filtration performance.

SUMMARY

It is an objective of the present disclosure to provide a fuel-filter abnormality detection device capable of detecting an abnormality where an unintended foreign matter passes through a fuel filter.

It is another objective of the present disclosure to provide a fuel-filter abnormality detection device capable of supplying fuel to an engine under a predetermined restriction after the abnormality of the fuel filter is detected.

According to an aspect of the present disclosure, a fuel-filter abnormality detection device is used for a subject filter provided in a fuel supply device of an engine to filtrate a fuel. The fuel-filter abnormality detection device includes a first filter is attachable downstream of the subject filter in fuel flow. A filtration capacity of the first filter is smaller than a filtration capacity of the subject filter. The first filter traps a foreign matter on a downstream side of the subject filter to cause a change in fuel pressure indicating an abnormality of the subject filter.

In the fuel-filter abnormality detection device, the first filter different from the subject filter is provided. The first filter makes the change in fuel pressure indicating an abnormality of the subject filter by trapping a foreign matter. Since the first filter has a smaller filtration capacity than that of the subject filter, the first filter is clogged promptly relatively. Therefore, an abnormality of the subject filter can be detected, even when the subject filter is absent, has no filter element therein, is a low-quality product inferior in filtration performance, or has a damaged filter element therein.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
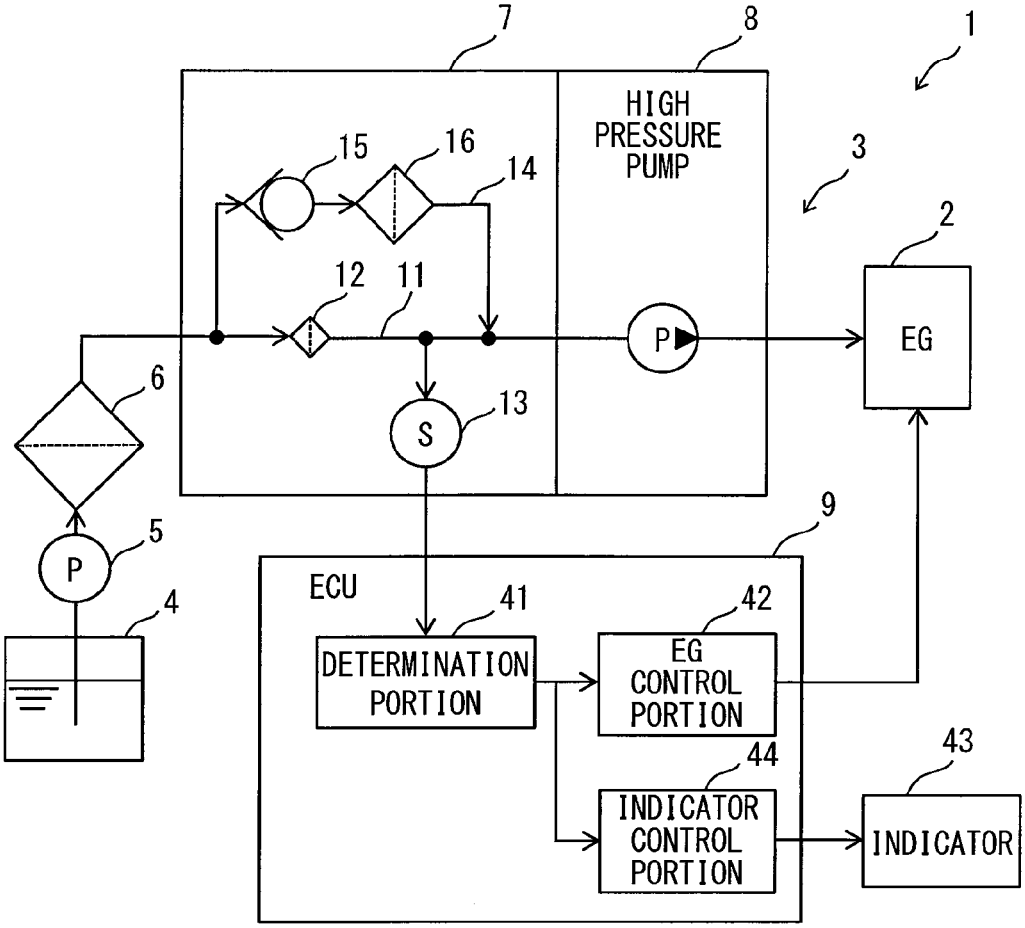
FIG. 1 is a block diagram showing a power system for a vehicle, according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. In succeeding embodiments, a part corresponding to a matter described in a preceding embodiment may be assigned a reference numeral different only in hundreds place for clarification of correspondence relation, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

In FIG. 1, a power system 1 for a vehicle is installed in a vehicle, and the power system 1 includes an internal combustion engine 2 for a vehicle, and a fuel supply device 3 that supplies a fuel to the engine 2. The engine 2 is installed in the vehicle to provide a power for vehicle running, a power for electricity generation and a power for driving devices such as an air conditioner. The engine 2 is, for example, a diesel engine that is a compression-ignition engine using a light oil as fuel.

The fuel supply device 3 draws the fuel from a fuel tank 4 and compresses the fuel to high pressure. The high pressure fuel compressed by the fuel supply device 3 is supplied to the engine 2 as an injected fuel. The fuel supply device 3 includes a low-pressure pump 5, a main filter 6 (subject filter), a detector 7 and a high-pressure pump 8, which are disposed in a fuel pathway. The low-pressure pump 5 draws the fuel from the fuel tank 4. The low-pressure pump 5 may be provided in the high-pressure pump 8.

The main filter 6 is provided between the fuel tank 4 and the detector 7 in a fuel flow. A total amount of the fuel flowing in the fuel pathway is filtrated through the main filter 6, and the main filter 6 removes a foreign matter from the fuel. The main filter 6 can be used over several tens of thousands kilometers in travel distance of the vehicle under a well-managed environment of fuel usage. The main filter 6 has a relatively-large filtration capacity so as not to be clogged for a short time, for example, for several hours even through a low-quality fuel containing much foreign matters is used as the fuel. The main filter 6 is configured to be detachable for replacement thereof. The main filter 6 is configured to be easily replaceable by a user or a worker. For example, the main filter 6 may be a cartridge filter including a casing and a filtration element housed in the casing. The cartridge filter is replaceable together with the casing. Alternatively, the main filter 6 may be an element-replaceable filter in that only a filtration element is replaceable.

The detector 7 detects an abnormality in the main filter 6. The detector 7 is attached to the high-pressure pump 8. The detector 7 is utilized for detecting leakage of the foreign matters, such that, breakage of a filtration element of the main filter 6, removal of the filtration element, or usage of a low-quality filtration element. Further, the detector 7 can be used also for detecting clogging of the main filter 6. The detector 7 is used as an example a fuel-filter abnormality detection device.

The detector 7 includes multiple members and is configured to be available as a single member. The detector 7 can be used as a detection unit in which the multiple members are integrated.

The detector 7 has a main passage 11 provided between the main filter 6 and the high-pressure pump 8 in the fuel flow. A sub filter 12 (first filter) is disposed in the main passage 11. The sub filter 12 is lower in filtration capacity than the main filter 6. The sub filter 12 is a relatively-low filtration capacity so as to be clogged within a short time, for example, within several hours when the low-quality fuel containing much foreign matters is used as the fuel. A smallest size of a foreign matter trappable by the sub filter 12 is smaller than or equal to a smallest size of a foreign matter trappable by the main filter 6. The smallest size of a foreign matter trappable by the sub filter 12 may be smaller than the smallest size of a foreign matter trappable by the main filter 6. These settings in pore size contribute to high-sensitive detection of the abnormality in the main filter 6.

A pressure sensor 13 is provided downstream of the sub filter 12 in the main passage 11 in the fuel flow. The pressure sensor 13 detects a fuel pressure between the sub filter 12 and the high-pressure pump 8 in the fuel flow. When the sub filter 12 is clogged, the fuel pressure downstream of the sub filter 12 decreases due to a suction action of the high-pressure pump 8. Also, when the main filter 6 is clogged, the fuel pressure downstream of the sub filter 12 decreased due to the suction action of the high-pressure pump 8. The pressure sensor 13 is utilized to detect such decrease in fuel pressure.

The detector 7 includes a bypass passage 14 through which the fuel bypasses the sub filter 12. The bypass passage 14 capable of connecting an upstream side of the sub filter 12 and a downstream side of the sub filter 12 in the fuel flow.

An on-off valve 15 and a bypass filter 16 (second filter) are disposed in the bypass passage 14. The bypass passage 14 is used as a fuel passage after the sub filter 12 is clogged. The fuel is supplied to the engine 2 through the bypass passage 14 for a predetermined period after the sub filter 12 is clogged. The bypass passage 14 provides a limp-home function to the vehicle after an abnormality in the main filter 6 is detected.

The on-off valve 15 is closed when the sub filter 12 is not clogged. The on-off valve 15 opens after the sub filter 12 is clogged. The on-off valve 15 is a differential pressure regulating valve that opens or closes in accordance with a pressure difference between on an upstream side of the on-off valve 15 and on a downstream side of the on-off valve 15. The on-off valve 15 is closed when the pressure difference between on the upstream side and on the downstream side is smaller than a predetermined value. The on-off valve 15 opens when the pressure difference between on the upstream side and on the downstream side exceeds the predetermined value, for example, due to decrease in pressure on the downstream side of the on-off valve 15. The on-off valve 15 may be used as an example of a bypass control valve which allows the fuel to flow from the upstream side of the sub filter 12 to the downstream side of the sub filter 12 through the bypass passage 14 when a change in fuel pressure indicating an abnormality of the main filter 6 occurs in the sub filter 12. The on-off valve 15 substantially shuts off the fuel flowing through the bypass passage 14 or allows the fuel to flow through the bypass passage 14.

The bypass filter 16 filtrates the fuel flowing through the bypass passage 14. The bypass filter 16 traps and removes a foreign matter from the fuel flowing through the bypass passage 14. A filtration capacity of the bypass filter 16 is smaller than the filtration capacity of the main filter 6 and larger than the filtration capacity of the sub filter 12. A smallest size of a foreign matter trappable by the bypass filter 16 is as large as the smallest size of a foreign matter trappable by the main filter 6. After the abnormality is detected in the main filter 6, and after the sub filter 12 is clogged, the bypass filter 16 filtrates the fuel supplied to the engine 2. Accordingly, for example, when the sub filter 12 is clogged due to deficiency in filtration performance of the main filter 6, the bypass filter 16 supplies a filtrated pure fuel to the engine 2.

The high-pressure pump 8 pressurizes the fuel under high pressure and supplies the fuel to the engine 2. The high-pressure pump 8 may include a vane pump and/or a plunger pump. The high-pressure pump 8 supplies the fuel to fuel injectors provided in multiple combustion cylinders of the engine 2. A system for supplying the fuel from the high-pressure pump 8 to the engine 2 may employ a variety of systems such as a common rail system, a distribution system and an in-line system.

The fuel supply device 3 includes a controller 9 that controls the engine 2 and the fuel supply device 3. The controller 9 is an electronic control device using a microcomputer. The controller 9 receives a signal outputted from the pressure sensor 13 that is a pressure detector, and determines whether the main filter 6 has an abnormality based on the signal. The controller 9 performs a fuel safe processing to protect the fuel supply device 3. The detector 7 and the controller 9 are used in cooperation with each other as the fuel-filter abnormality detection device.

The controller 9 is an electronic control unit. The controller 9 includes at least one processing unit (CPU), and at least one memory device (MMR) as a storage medium storing a program and data. The controller 9 is provided by a microcomputer including a storage medium that is readable out by a computer. The storage medium permanently stores therein a program readable out by a computer. The storage medium may include a semiconductor memory or a magnetic disc. The controller 9 may include a single computer or a set of computer resources linked to each other by a data communication device. The program is performed by the controller 9, thereby making the controller 9 function as a device described in the present specification and making the controller 9 function to perform methods described in the present specification. The controller 9 provides various elements. At least one part of these elements can be referred to as a device performing a function, and in a different perspective, at least one part of the elements can be referred to as a configuration block or a module.

The controller 9 receives a pressure signal detected by the pressure sensor 13. The controller 9 detects an abnormality of the main filter 6 based on the pressure signal. The controller 9 performs the fuel safe processing when detecting the abnormality of the main filter 6. The controller 9 is capable of controlling the engine 2 for performing the fuel safe processing. For example, the controller 9 stops fuel supply to the engine 2 and controls a component of the engine 2 to stop the engine 2. For example, the controller 9 drives a fuel shut-off valve or a fuel injection valve into a closed state. Alternatively, the controller 9 may restrict an output of the engine 2 so as to provide the limp-home function. For example, the controller 9 is capable of providing the limp-home function by limiting a rotation speed of the engine 2 to a predetermined limitation rotation speed or less.

The controller 9 includes an abnormality determination portion 41 that receives a pressure signal from the pressure sensor 13 and determines whether the main filter 6 has an abnormality. The abnormality determination portion 41 is capable of storing a detection value of the pressure sensor 13 as an initial value when the main filter 6 has no abnormality and when the sub filter 12 is not clogged. For example, the abnormality determination portion 41 may store a pressure value as the initial value in an early period of use after the power system 1 is manufactured in a plant. The abnormality determination portion 41 sets a predetermined threshold standard for determining based on the above-described initial value whether the main filter 6 has an abnormality, i.e. whether the sub filter 12 is clogged. The abnormality determination portion 41 determines that the main filter 6 has an abnormality when the pressure value corresponding to the pressure signal from the pressure sensor 13 is lower than the above-described predetermined threshold standard.

The controller 9 includes an engine control portion 42 that controls the engine 2 when the abnormality determination portion 41 determines that the main filter 6 has an abnormality. In the present embodiment, the engine control portion 42 limits the rotation speed of the engine 2 to the limitation rotation speed or less. The engine control portion 42 may be referred to as an output limiting portion that limits an output of the engine 2. Accordingly, a flow rate of the fuel can be reduced, and an amount of the foreign matter reaching the high-pressure pump 8 can be reduced. Additionally, an amount of the foreign matter reaching the fuel injection valve can be reduced.

The controller 9 includes an indicator control portion 44 that informs a person using the vehicle of the abnormality of the main filter 6 by using an indicator 43 when the abnormality determination portion 41 determines that the main filter 6 has the abnormality. The engine control portion 42 and the indicator control portion 44 are used as a fuel safe control portion that performs the fuel safe processing. The indicator 43 and the indicator control portion 44 are used as a warning device that alerts the user. The detector 7 and the controller 9 are used as an abnormality detection device that detects whether the main filter 6 has an abnormality.

Figure 2:
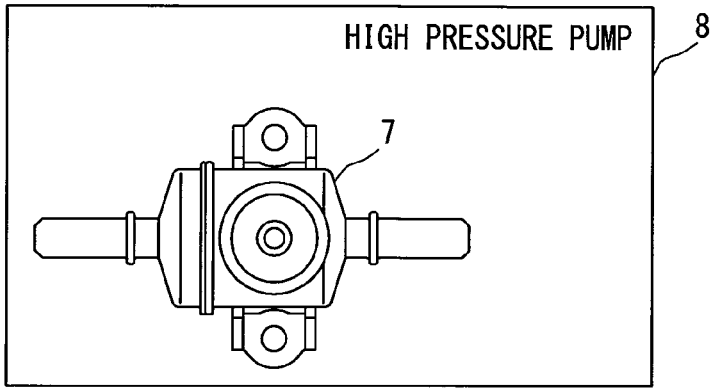
FIG. 2 is a schematic view showing a fuel-filter abnormality detection device in a fixed state, according to the first embodiment.

As shown in FIG. 2, the detector 7 is configured to be a unit attachable to the high-pressure pump 8. The detector 7 is attached to the high-pressure pump 8 by multiple bolts. The detector 7 is replaceable. The detector 7 is fixed to the high-pressure pump 8 such that the detector 7 is more difficult and complex to be replaced than the main filter 6 is. For example, the main filter 6 can be replaced without removing a hose, but the hose is required to be removed when the detector 7 is replaced. Further, the detector 7 is provided at an inconspicuous position so as to be concealed. The detector 7 is provided at a position where a general user hesitates to treat. In the present embodiment, the detector 7 is attached to the high-pressure pump 8 that requires a special apparatus for maintenance. Accordingly, the detector 7 can be prevented from being removed. On the other hand, an authorized worker that understands functions of the detector 7 can replace the detector 7.

Figure 3:
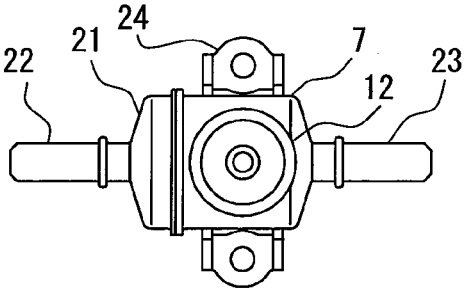
FIG. 3 is a top view showing the fuel-filter abnormality detection device according to the first embodiment.
Figure 4:
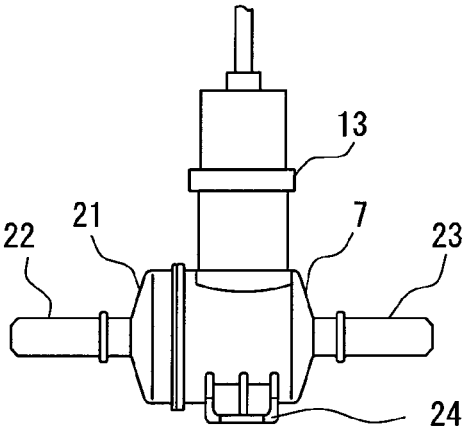
FIG. 4 is a front view showing the fuel-filter abnormality detection device according to the first embodiment.
Figure 5:
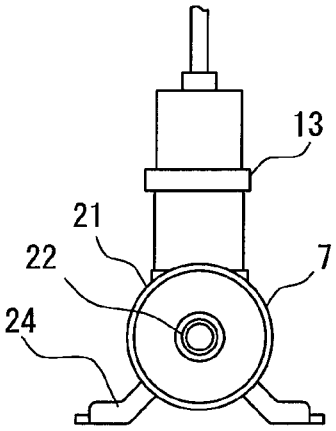
FIG. 5 is a side view showing the fuel-filter abnormality detection device according to the first embodiment.

As shown in FIGS. 3, 4 and 5, the detector 7 includes a housing 21 that is made of resin and has a fuel passage. The housing 21 includes a fuel inlet pipe 22 and a fuel outlet pipe 23. The housing 21 includes two brackets 24 for bolt fixation to support the detector 7. The fuel inlet pipe 22 and the fuel outlet pipe 23 are connected to hoses providing the fuel passage. The housing 21 accommodates the sub filter 12. The housing 21 is detachably fixed in the fuel supply device 3 such that the housing 21 is replaceable. The housing 21 is configured to be more complex or/and more difficult to be replaced than the main filter 6 is to be replaced. Since the housing 21 is fixed to the high-pressure pump 8, replacement of the housing 21 becomes difficult. Since the housing 21 is fixed by multiple bolts and connected to two hoses, replacement of the housing 21 becomes complex.

Figure 6:
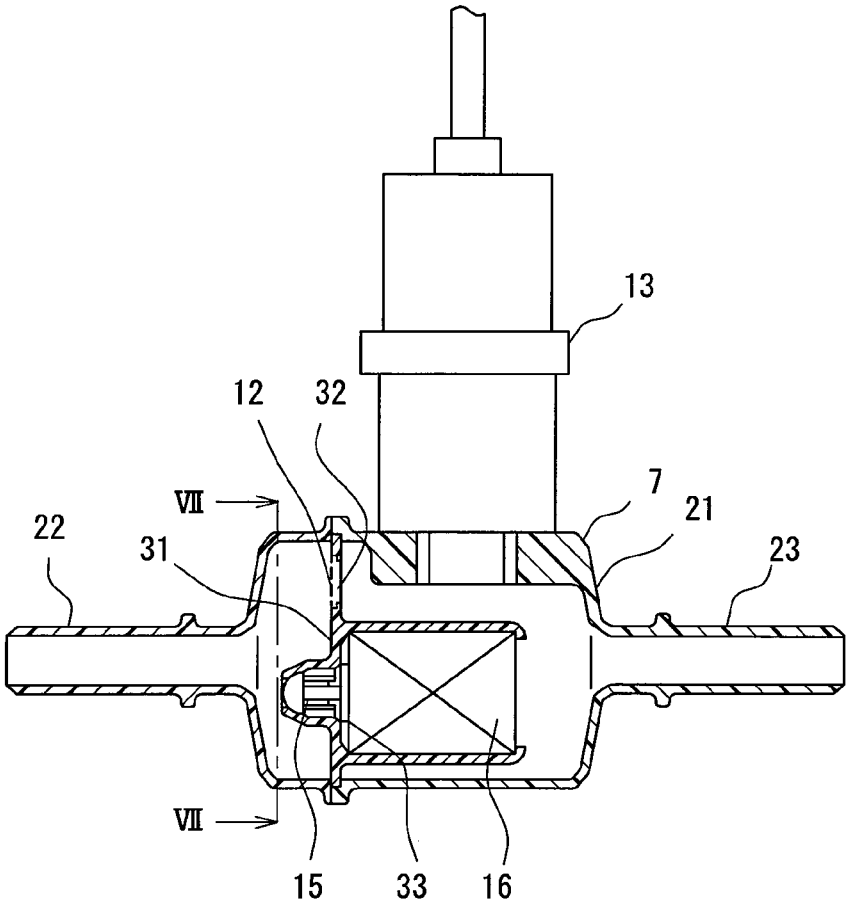
FIG. 6 is a schematic sectional diagram showing the fuel-filter abnormality detection device according to the first embodiment.
Figure 7:
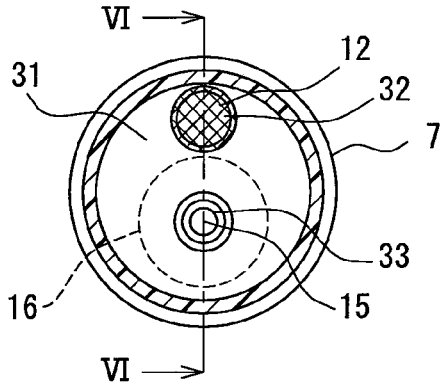
FIG. 7 is a schematic sectional diagram showing the fuel-filter abnormality detection device according to the first embodiment.

FIGS. 6 and 7 show an inner part of the detector 7. FIG. 6 is a sectional diagram taken along a line VI-VI of FIG. 7, and FIG. 7 is a sectional diagram taken along a line VII-VII of FIG. 6. A partition plate 31 is provided in the housing 21 and partitions the fuel passage inside the housing 21 into an upstream space and a downstream space. The partition plate 31 has two opening portions. One opening portion 32 provides the main passage 11, and the sub filter 12 is provided in the opening portion 32. The sub filter 12 may be a mesh filter. Another opening portion 33 provides the bypass passage 14. In the opening portion 33, the on-off valve 15 and the bypass filter 16 are arranged in series with respect to the flow direction of the fuel.

The pressure sensor 13 detects a fuel pressure downstream of the sub filter 12 through a through hole that is provided in the housing 21 of the detector 7. The pressure sensor 13 is configured to be detachable from the housing 21. Hence, when the sub filter 12 is replaced, the pressure sensor 13 expensive relatively can be reused. The sub filter 12, the on-off valve 15 and the bypass filter 16 which are immersed in the fuel passage can be treated together with the housing 21. Thus, these multiple members which are preferable to be replaced at one time can be replaced at one time when the sub filter 12 is replaced.

The pressure sensor 13 is detachably provided in the housing 21. The pressure sensor 13 is used as a pressure detector that detects a fuel pressure in the housing 21. The fuel pressure in the housing 21 is dependent on clogging of the sub filter 12. According to this configuration, the members attached to the housing 21, other than the pressure sensor 13, can be replaced at one time. When the housing 21 is omitted, the pressure sensor 13 does not detect a normal pressure. Thus, the controller 9 is capable of determining by self-diagnosis that the pressure sensor 13 is in an abnormal attachment state. Hence, an improper use, for example, a use without the whole housing 21, or a use without a member attached to the housing 21, such as the sub filter 12, can be restricted.

As shown in FIG. 1, the fuel drawn from the fuel tank 4 by the low-pressure pump 5 is filtrated through the main filter 6, passes through the sub filter 12, and is supplied to the high-pressure pump 8. When the main filter 6 delivers a normal filtration performance, few foreign matters reach the sub filter 12. Thus, the sub filter 12 allows the fuel supply without being clogged. Consequently, the engine 2 is operated.

The main filter 6 may be exchanged for a new one at a service shop authorized by a manufacturer of the vehicle. In this case, an authentic product recommended by the manufacturer is used as the new one. On the other hand, the main filter 6 may be exchanged by a user of the vehicle or a repair shop unauthorized by the manufacturer. In such case, the main filter 6 may be replaced with a low-quality filter. The low-quality filter has a low filtration performance, and may allow unintended foreign matters to pass therethrough. Further, the power system 1 may possibly be changed such that the fuel is capable of flowing without providing the main filter 6. In addition, even when the authentic product is used, the main filter 6 may be deteriorated by long-term use more than its available period, and the main filter 6 may allow the unintended foreign matters to flow therethrough. In these cases, the foreign matters may cause various negative impacts. For example, abnormal abrasion in the high-pressure pump, clogging of an orifice, and accumulation of the foreign matters may occur. These negative impacts may deteriorate an operation of the engine 2.

When the main filter 6 does not deliver a normal filtration performance, the foreign matters reach the sub filter 12 through the main filter 6. The foreign matters are trapped by the sub filter 12. The filtration capacity of the sub filter 12 is much smaller than the filtration capacity of the main filter 6. The filtration capacity of the sub filter 12 may be set lower than one tenth of the normal filtration capacity of the main filter 6. The filtration capacity of the sub filter 12 may be set lower than one hundredth of the normal filtration capacity of the main filter 6. The filtration capacity of the sub filter 12 is set such that the sub filter 12 is clogged within a few hours without the main filter 6 and a fuel pressure downstream of the sub filter 12 reduces to a detectable level.

A time period, in which the fuel supply device 3 and the engine 2 can be allowed to be operated in a case where the fuel is not filtrated by the main filter 6, is defined as an allowable period. A time period, until clogging causing a pressure change detectable by the pressure sensor 13 occurs in the sub filter 12 in a case where the fuel is not filtrated by the main filter 6, is defined as a clogging period. The filtration capacity of the sub filter 12 is set such that the clogging period becomes shorter than or equal to the allowable period. The filtration capacity of the sub filter 12 is set such that a pressure change corresponding to an abnormality of the main filter 6 occurs in the clogging period within the allowable period. In other words, the filtration capacity of the sub filter 12 is set based on the allowable period and the clogging period. Since the clogging period is set within the allowable period, an operation of the fuel supply device 3 and an operation of the engine 2 over a long period in a state where the main filter 6 does not deliver a necessary filtration performance can be restricted.

The pressure sensor 13 detects a fuel pressure downstream of the sub filter 12 in the fuel flow, and thus reduction of the fuel pressure downstream of the sub filter 12 is detected by the pressure sensor 13. When the abnormality determination portion 41 determines that the pressure reduction exceeds a predetermined threshold standard, the abnormality determination portion 41 determines that the main filter 6 has an abnormality. After determining that the main filter 6 has the abnormality, the abnormality determination portion 41 keeps the abnormality determination until a predetermined reset operation, such as replacement of the detector 7, is performed. Such keeping function of the abnormality determination portion 41 contributes to prevention of cancelling of the abnormality determination after opening of the on-off valve 15 described below.

When the main filter 6 is determined to have an abnormality, the abnormality determination portion 41 outputs a command signal to the engine control portion 42 and the indicator control portion 44. In response to the command signal, the engine control portion 42 limits the rotation speed of the engine 2. In response to the command signal, the indicator control portion 44 drives the indicator 43. The indicator 43 provides a user of the vehicle with the warning that the main filter 6 has a potential to have an abnormality and that replacement of the main filter 6 and the detector 7 are recommended. The indicator 43 may include an independent warning indicator or a display of a navigation device installed in the vehicle.

When the sub filter 12 becomes into a predetermined clogged state, the pressure difference between upstream and downstream of the on-off valve 15 exceeds a valve-opening pressure difference at which the on-off valve 15 opens. The on-off valve 15 opens the bypass passage 14 in response to the valve-opening pressure difference. As a result, the fuel is supplied to the engine 2 through the bypass passage 14. When the fuel passes through the bypass passage 14, the bypass filter 16 filtrates the fuel.

The valve-opening pressure difference of the on-off valve 15 is set such that the on-off valve 15 is changed from a valve-closed state to a valve-open state when the abnormality determination portion 41 determines that the main filter 6 has an abnormality. When the on-off valve 15 opens, a fuel pressure downstream of the sub filter 12 increases. The valve-opening pressure difference of the on-off valve 15 may be set to be higher than a pressure difference which is used as the threshold standard for the determination of an abnormality of the main filter 6 by the abnormality determination portion 41.

The user can activate the engine 2 and drive the vehicle even after being informed of an abnormality of the main filter 6 by the indicator 43. The user can replace the main filter 6 and the detector 7 with new ones after running the vehicle to a service shop or a home, for example. Since the pressure sensor 13 is detachable from the housing 21 of the detector 7, the pressure sensor 13 can be reused. When both the main filter 6 and the detector 7 including the sub filter 12 are replaced, the controller 9 performs a reset processing to return the engine 2 to a normal controlled state. Simultaneously, the controller 9 restarts detection of an abnormality of the main filter 6.

Second Embodiment

Figure 8:
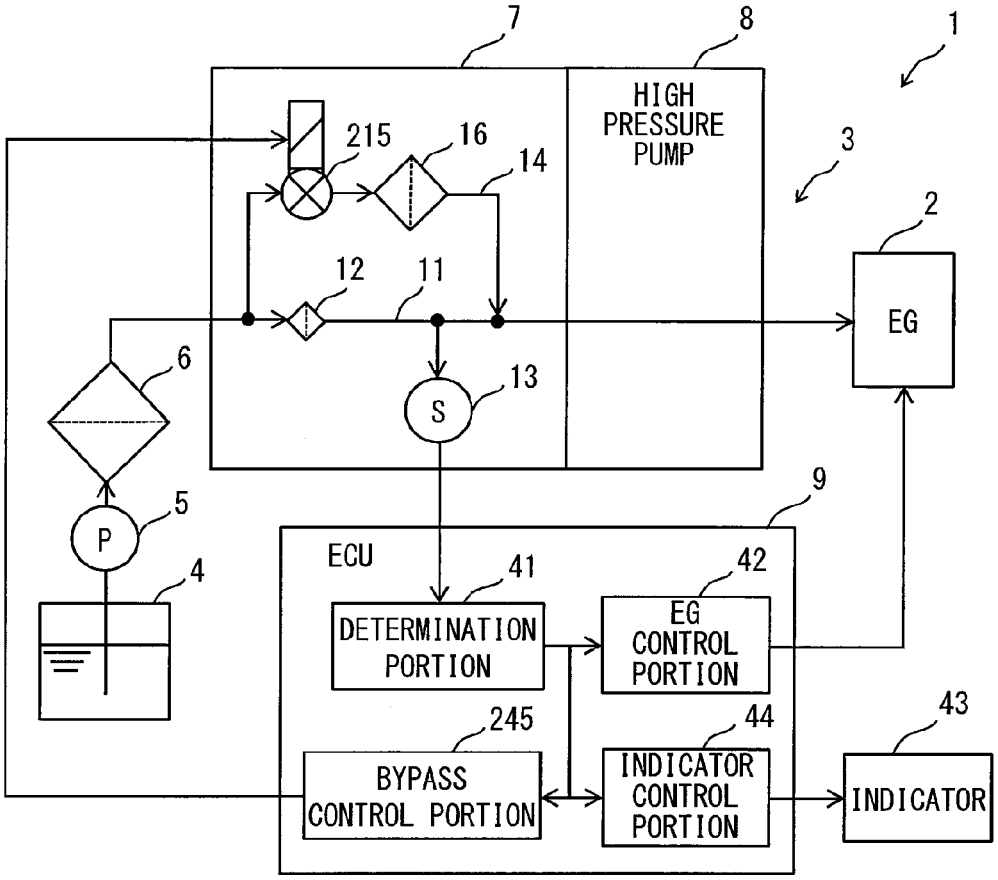
FIG. 8 is a block diagram showing a power system for a vehicle, according to a second embodiment of the present disclosure.

A second embodiment is a modification where the preceding embodiment is used as a basic embodiment. In the above-described first embodiment, the on-off valve 15 which responds to a pressure difference is adopted as the bypass control valve. Alternatively, as shown in FIG. 8, an electromagnetic on-off valve 215 in the present embodiment is used. The controller 9 includes a bypass control portion 245 that controls the on-off valve 215. The bypass control portion 245 controls the on-off valve 215 to be in a valve-closed state during a period through which the main filter 6 is determined to be normal.

The on-off valve 215 is coupled to the housing 21 detachably, similar to the pressure sensor 13. In other words, members other than the on-off valve 215 and the pressure sensor 13 in the detector 7 of the present embodiment are replaceable together with the housing 21. More specifically, the sub filter 12 and the bypass filter 16 are replaceable together with the housing 21.

The bypass control portion 245 controls the on-off valve 215 to be a valve-open state intermittently after abnormality of the main filter 6 is detected. Also in the present embodiment, similar effects to the above-described embodiment can be obtained.

Third Embodiment

Figure 9:
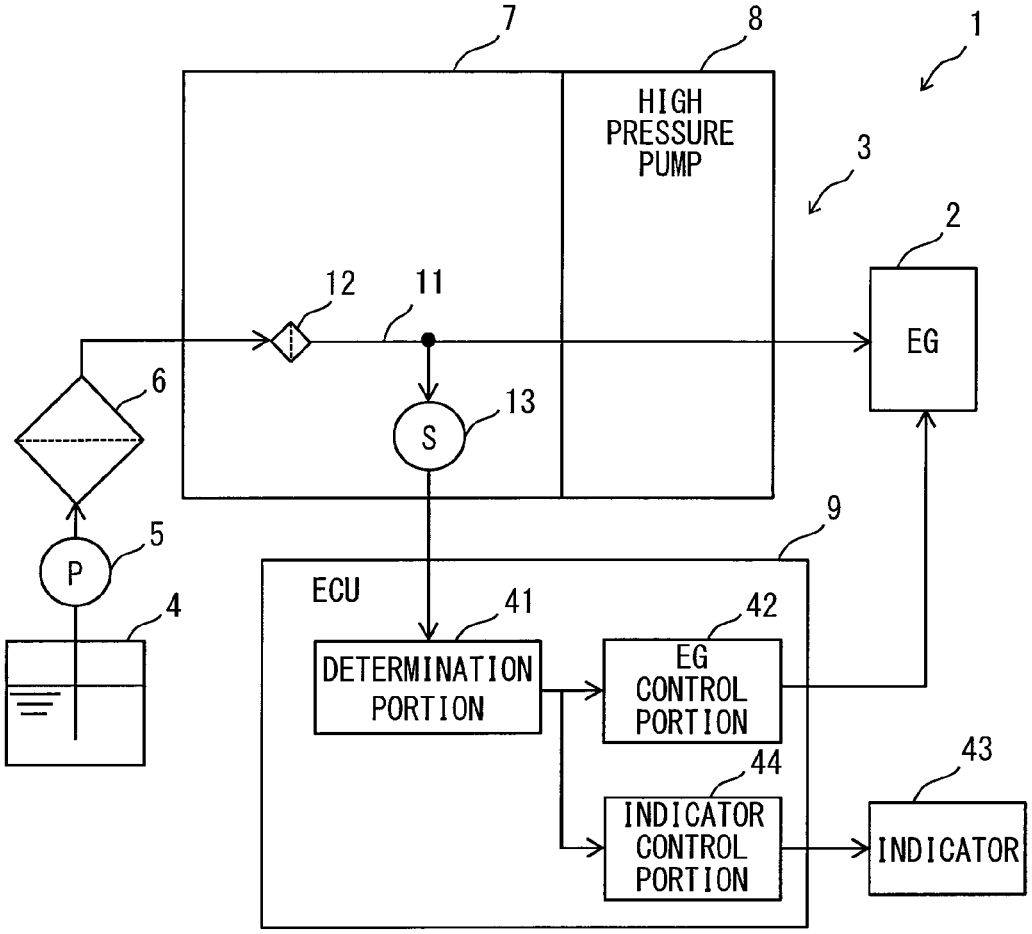
FIG. 9 is a block diagram showing a power system for a vehicle, according to a third embodiment of the present disclosure.

A third embodiment is a modification where the preceding embodiments are used as basic embodiments. In the above-described embodiments, the bypass passage 14 and associated members are used. Alternatively, as shown in FIG. 9, the bypass passage 14, the on-off valve 15, 215, and the bypass filter 16 are omitted in the present embodiment. In this configuration, when the sub filter 12 reach a clogged level where a predetermined pressure loss generates, the controller 9 performs the fuel safe processing. In the fuel safe processing, the engine 2 can be operated by using a limited amount of fuel capable of passing through the sub filter 12. Also in the present embodiment, similar effects to the above-described embodiment can be obtained.

Although the present disclosure has been fully described in connection with the preferred embodiments thereof with reference to the accompanying drawings, it is to be noted that various changes and modifications will become apparent to those skilled in the art. The present disclosure is not limited to the combinations shown in the embodiments, and can be exploited with other various combinations. The embodiments may further include an additional portion. Explanation of a part of the embodiments may be omitted. A part of the embodiment may be replaced or combined with a part of another embodiment. Configurations, actions and effects of the embodiments are just examples of the present disclosure. The technical scope of the present disclosure is not limited to the description of the embodiments.

For example, methods and functions provided by the controller may be provided by software only, hardware only, or a combination of software and hardware. For example, the controller may include an analog circuit.

In the above-described embodiments, the engine 2 is a diesel engine. Alternatively, the engine 2 may be a spark-ignition engine.

In the above-described embodiments, the pressure sensor 13 is attached to the detector 7. Alternative to this, the pressure sensor 13 may be provided in an inlet portion of the high-pressure pump 8. The sub filter 12 and the bypass filter 16 may be provided in two separate housings, respectively, and only the sub filter 12 may be replaceable.

In the above-described embodiments, a fuel pressure is detected only on the downstream side of the sub filter 12 in the fuel flow. Alternatively, a pressure increase may be detected on an upstream side of the sub filter 12 in the fuel flow, and clogging of the sub filter 12, i.e. abnormality of the main filter 6 may be determined accordingly. Alternatively, fuel pressures on both upstream and downstream sides of the sub filter 12 may be detected and used for determination of an abnormality of the main filter 6. Instead of the pressure sensor 13, a pressure switch responsive to a pressure decrease on the downstream side of the sub filter 12 may be provided. For example, a switch that detects switching of the on-off valve 15 from the valve-closed state to the valve-open state may be used.

In the above-described embodiments, the fuel safe processing is performed by limiting output of the engine 2. Alternatively, the engine 2 may be stopped. In the above-described embodiments, the pressure sensor 13 and the controller 9 are adopted as a control device. Alternatively, only the sub filter 12 is provided in the housing 21, and the output of the engine 2 may be reduced in accordance with decrease in fuel supply due to clogging of the sub filter 12. In this case, the fuel-filter abnormality detection device can be made smaller and provided at low cost.

Additional advantages and modifications will readily occur to those skilled in the art. The disclosure in its broader terms is therefore not limited to the specific details, representative apparatus, and illustrative examples shown and described.

What is claimed is:

1. A fuel supply device for supplying fuel to an engine and configured to filtrate the fuel, comprising:

a fuel pathway installed in a vehicle together with the engine and supplying fuel from a fuel tank to the engine, a main filter housed within a main filter casing and provided in the fuel pathway; and a fuel-filter abnormality detection device provided in the fuel pathway and configured to detect a fuel-filter abnormality of the main filter;

the fuel-filter abnormality detection device comprising:

a first filter removably attached downstream of the main filter in the fuel pathway, the first filter having a filtration capacity smaller than a filtration capacity of the main filter, the first filter trapping foreign matter on a downstream side of the main filter resulting in a change in fuel pressure indicating an abnormality of the main filter;

a second filter provided in a bypass passage that bypasses the first filter of the fuel-filter abnormality detection device, the second filter being configured to filtrate the fuel flowing in the bypass passage; and a detector housing that houses the first filter, the second filter and the bypass passage, wherein the fuel-filter abnormality detection device is a combination of the first filter, the second filter and the bypass passage which are assembled into a single detector replacement part of the fuel supply device, the single detector replacement part being removably connected to the fuel supply device and being replaceable separately from the main filter and the main filter casing of the fuel supply device, wherein the main filter has a configuration permitting replacement of the main filter with a degree of replacement difficulty corresponding to disconnecting a used main filter from the fuel pathway and connecting the main filter to the fuel pathway, the single detector replacement part includes at least one of an attached pump and a data connection, and the single detector replacement part has a configuration inhibiting replacement of the single detector replacement part with a degree of replacement difficulty higher than that of the main filter corresponding to disconnecting a used single detector replacement part from the fuel pathway and connecting the single detector replacement part to the fuel pathway including connecting at least one of the pump attached to the single detector replacement part to the fuel pathway and the data connection of the single detector replacement part to a computer.

2. The fuel supply device according to claim 1, wherein the filtration capacity of the first filter is set such that the change in fuel pressure indicating the abnormality of the main filter occurs within an allowable period during which the main filter is incapable of filtrating the fuel and an operation of the fuel supply device is allowable.

3. The fuel supply device according to claim 1, wherein the detector housing includes a bracket for bolt fixation to an object.

4. The fuel supply device according to claim 1, further comprising a pressure detector that is detachably provided in the detector housing and configured to detect a fuel pressure sensitive to clogging of the first filter of the fuel-filter abnormality detection device.

5. The fuel supply device according to claim 4, further comprising a controller configured to receive a signal outputted from the pressure detector, determine an abnormality of the main filter based on the signal, and perform a fuel safe processing to protect the fuel supply device.

6. The fuel supply device according to claim 1, further comprising a bypass control valve configured to allow the fuel to flow from an upstream side of the first filter to a downstream side of the first filter through the bypass passage when the change in fuel pressure indicating the abnormality of the main filter occurs in the first filter.

7. The fuel supply device according to claim 1, further comprising:

a pressure detector that is detachably provided in the detector housing and configured to detect a fuel pressure sensitive to clogging of the first filter of the fuel-filter abnormality detection device; and a controller configured to receive a signal outputted from the pressure detector, determine an abnormality of the main filter based on the signal, and perform a fuel safe processing to protect the fuel supply device, wherein the detector housing is replaceable together with the first filter.

8. The fuel supply device according to claim 7, further comprising a bypass control valve provided in the detector housing and configured to allow the fuel to flow from an upstream side of the first filter to a downstream side of the first filter through the bypass passage when the change in fuel pressure indicating the abnormality of the main filter occurs in the first filter, wherein the second filter is replaceable together with the detector housing.

9. The fuel supply device according to claim 6, wherein a filtration capacity of the second filter is smaller than the filtration capacity of the main filter and larger than the filtration capacity of the first filter.

10. The fuel supply device according to claim 8, wherein a filtration capacity of the second filter is smaller than the filtration capacity of the main filter and larger than the filtration capacity of the first filter.

11. The fuel supply device according to claim 1, wherein the detector housing includes a partition plate separating an inner space of the detector housing into an upstream space and a downstream space in a fuel flow, and the partition plate includes a first opening through which the fuel flows to be filtrated by the first filter, and a second opening through which the fuel flows to be filtrated by the second filter in the bypass passage.

12. The fuel supply device according to claim 11, further comprising a bypass control valve provided in the second opening of the partition plate and configured to allow the fuel to flow from the upstream space to the downstream space through the second opening in the bypass passage when the change in fuel pressure indicating the abnormality of the main filter occurs in the first filter.

13. The fuel supply device according to claim 1, wherein the single detector replacement part includes the attached pump.

14. The fuel supply device according to claim 1, wherein the single detector replacement part includes the data connection.

15. A fuel supply device for supplying fuel to an engine and configured to filtrate the fuel, comprising:

a main filter housed within a main filter casing; and a fuel-filter abnormality detection device provided in the fuel supply device and configured to detect a fuel-filter abnormality of the main filter;

the fuel-filter abnormality detection device comprising:

a first filter removably attached downstream of the main filter in fuel flow, the first filter having a filtration capacity smaller than a filtration capacity of the main filter, the first filter trapping foreign matter on a downstream side of the main filter resulting in a change in fuel pressure indicating an abnormality of the main filter;

a second filter provided in a bypass passage that bypasses the first filter of the fuel-filter abnormality detection device, the second filter being configured to filtrate the fuel flowing in the bypass passage; and a detector housing that houses the first filter, the second filter and the bypass passage, wherein the fuel-filter abnormality detection device is a combination of the first filter, the second filter and the bypass passage which are assembled into a single detector replacement part of the fuel supply device, the single detector replacement part being removably connected to the fuel supply device and being replaceable separately from the main filter and the main filter casing of the fuel supply device, the single detector replacement part has a configuration inhibiting replacement of the single detector replacement part and having a degree of replacement difficulty higher than a degree of replacement difficulty of the main filter and including the detector housing of the single detector replacement part being fixed to a pump which pressurizes the fuel flowing out of the detector housing and supplies the fuel to the engine.

16. The fuel supply device according to claim 15, wherein the detector housing of the single detector replacement part is fixed to the pump while the main filter is not fixed to the pump.

17. The fuel supply device according to claim 13, wherein the pump attached to the single detector replacement part is configured to pressurize the fuel flowing out of the detector housing of the single detector replacement part and supplies the fuel to the engine.

18. The fuel supply device according to claim 15, wherein the filtration capacity of the first filter is set such that the change in fuel pressure indicating the abnormality of the main filter occurs within an allowable period during which the main filter is incapable of filtrating the fuel and an operation of the fuel supply device is allowable.

19. The fuel supply device according to claim 15, wherein the detector housing includes a bracket for bolt fixation to an object.

20. The fuel supply device according to claim 15, further comprising a pressure detector that is detachably provided in the detector housing and configured to detect a fuel pressure sensitive to clogging of the first filter of the fuel-filter abnormality detection device.

21. The fuel supply device according to claim 20, further comprising a controller configured to receive a signal outputted from the pressure detector, determine an abnormality of the main filter based on the signal, and perform a fuel safe processing to protect the fuel supply device.

22. The fuel supply device according to claim 15, further comprising a bypass control valve configured to allow the fuel to flow from an upstream side of the first filter to a downstream side of the first filter through the bypass passage when the change in fuel pressure indicating the abnormality of the main filter occurs in the first filter.

23. The fuel supply device according to claim 15, further comprising:

a pressure detector that is detachably provided in the detector housing and configured to detect a fuel pressure sensitive to clogging of the first filter of the fuel-filter abnormality detection device; and a controller configured to receive a signal outputted from the pressure detector, determine an abnormality of the main filter based on the signal, and perform a fuel safe processing to protect the fuel supply device, wherein the detector housing is replaceable together with the first filter.

24. The fuel supply device according to claim 23, further comprising a bypass control valve provided in the detector housing and configured to allow the fuel to flow from an upstream side of the first filter to a downstream side of the first filter through the bypass passage when the change in fuel pressure indicating the abnormality of the main filter occurs in the first filter, wherein the second filter is replaceable together with the detector housing.

25. The fuel supply device according to claim 22, wherein a filtration capacity of the second filter is smaller than the filtration capacity of the main filter and larger than the filtration capacity of the first filter.

26. The fuel supply device according to claim 24, wherein a filtration capacity of the second filter is smaller than the filtration capacity of the main filter and larger than the filtration capacity of the first filter.

27. The fuel supply device according to claim 15, wherein the detector housing includes a partition plate separating an inner space of the detector housing into an upstream space and a downstream space in a fuel flow, and the partition plate includes a first opening through which the fuel flows to be filtrated by the first filter, and a second opening through which the fuel flows to be filtrated by the second filter in the bypass passage.

28. The fuel supply device according to claim 27, further comprising a bypass control valve provided in the second opening of the partition plate and configured to allow the fuel to flow from the upstream space to the downstream space through the second opening in the bypass passage when the change in fuel pressure indicating the abnormality of the main filter occurs in the first filter.

29. The fuel supply device according to claim 15, wherein the single detector replacement part further includes a data connection.

30. The fuel supply device according to claim 15, wherein the pump attached to the single detector replacement part is configured to pressurize the fuel flowing out of the detector housing of the single detector replacement part and supplies the fuel to the engine.

* * * * *